US010988935B2

(12) United States Patent
Rebonato

(10) Patent No.: US 10,988,935 B2
(45) Date of Patent: Apr. 27, 2021

(54) SCREEN COVERING

(71) Applicant: RENSON SUNPROTECTION-SCREENS NV, Waregem (BE)

(72) Inventor: Armando Rebonato, San Lazzaro di Savena (IT)

(73) Assignee: CORRADI S.R.L.

( * ) Notice: Subject to any disclaimer, the term of this patent is extended or adjusted under 35 U.S.C. 154(b) by 336 days.

(21) Appl. No.: 15/773,556

(22) PCT Filed: Nov. 2, 2017

(86) PCT No.: PCT/IB2017/056814

§ 371 (c)(1),
(2) Date: May 3, 2018

(87) PCT Pub. No.: WO2018/087632

PCT Pub. Date: May 17, 2018

(65) Prior Publication Data

US 2020/0248458 A1 Aug. 6, 2020

(30) Foreign Application Priority Data

Nov. 9, 2016 (IT) ..... 102016000112860

(51) Int. Cl.
*E04F 10/06* (2006.01)
*E04H 15/58* (2006.01)

(52) U.S. Cl.
CPC ..... *E04F 10/0607* (2013.01); *E04F 10/0655* (2013.01); *E04F 10/0648* (2013.01); *E04F 10/0681* (2013.01); *E04F 10/0685* (2013.01); *E04H 15/58* (2013.01)

(58) Field of Classification Search
CPC ..... E04F 10/0655; E04F 10/0685; E04F 10/0681; E04F 10/0648; E04H 15/58
See application file for complete search history.

(56) References Cited

FOREIGN PATENT DOCUMENTS

| | | | | |
|---|---|---|---|---|
| DE | 19600925 B4 * | 3/2009 | ..... | E04D 13/174 |
| EP | 1842980 A2 * | 10/2007 | ..... | E04F 10/0607 |
| EP | 2011932 A1 * | 1/2009 | ..... | E04F 10/0607 |
| EP | 2 578 767 A | 4/2013 | | |
| EP | 2136013 B1 * | 8/2015 | ..... | E04F 10/0607 |
| EP | 2351896 B1 * | 7/2016 | ..... | E04F 10/0681 |
| EP | 3511489 A1 * | 7/2019 | ..... | E04H 15/58 |
| FR | 3042802 A1 * | 4/2017 | ..... | E04F 10/08 |
| GB | 2291901 A * | 2/1996 | ..... | E04B 7/166 |
| WO | WO 2014/136095 A1 | 9/2014 | | |

OTHER PUBLICATIONS

International Search Report dated Dec. 20, 2017.

* cited by examiner

*Primary Examiner* — Babajide A Demuren
(74) *Attorney, Agent, or Firm* — Fresh IP PLC; Clifford D. Hyra; Aubrey Y. Chen

(57) ABSTRACT

A screen covering (1) comprising:
several cross-beams (2) arranged so as to be slidable away from each other and towards each other;
a screen (3) supported by the cross-beams (2) and foldable between the cross-beams (2) at sliding of the cross-beams (2);
and a lateral gutter (4), which extends essentially perpendicular to the cross-beams (2) and is arranged below a lateral side of the screen (3);
wherein said lateral side of the screen (3) is provided with a downwardly extending drip guard (5), which is foldable at sliding of the cross-beams (2).

6 Claims, 4 Drawing Sheets

Fig. 1 State of the art

SCREEN COVERING

The present application claims priority from Italian Patent Application No. 102016000112860 filed on Nov. 9, 2016, which is incorporated herein by reference.

FIELD OF THE DISCLOSURE

This disclosure relates to a screen covering comprising:

several cross-beams arranged so as to be slidable away from each other and towards each other;

a screen supported by the cross-beams and foldable between the cross-beams at sliding of the cross-beams;

and a lateral gutter, which extends essentially perpendicular to the cross-beams and is arranged below a lateral side of the screen.

BACKGROUND

Screen coverings of this type are usually erected in order to cover or to clear an outdoor area. By sliding the cross-beams away from each other, the screen can be extended to cover the area below the screen and by sliding the cross-beams towards each other, the screen is folded, such that this area can be cleared.

Such screen coverings are thus often erected at residences, restaurants, shops and the like in order to shield an outdoor terrace or the like from the sun, precipitation and/or wind or conversely to allow sunshine in temporarily. Said screen coverings may be configured in the form of awnings, pergolas, verandas, terrace coverings, carports, etc.

With such type of screen coverings it is difficult to arrange a said lateral gutter below the lateral side of the screen, allowing draining of precipitation along this lateral side of the screen and yet allowing the screen to fold above this lateral gutter. In order for precipitation to drain off into the gutter, an inner side wall of the lateral gutter is arranged underneath the screen and an outer side wall of the lateral gutter extends beside the screen. In order to enable the screen to fold, the screen however needs to be arranged at a certain distance with respect to the inner side wall of the lateral gutter. The inner side wall cannot be made sufficiently high to ensure that precipitation is kept inside the lateral gutter. With lateral drainage of precipitation, a known problem is therefore dripping of precipitation along the lateral sides of the screen, falling next to the inner side wall of the lateral gutter, in the area below the screen.

In order to solve this problem, several solutions have been proposed yet.

The lateral gutter or parts thereof have already been arranged moveable, in order to bring the inner side wall closer to the position where the precipitation falls from the screen, in order to minimize dripping and in order to assure at folding of the screen, that this inner side wall does not hinder the screen to fold above this lateral gutter.

In EP 1 842 980 A1 the lateral sides of the screen are provided with edge portions, preventing precipitation from overflowing, and the cross-beams are provided with cross channels for discharging precipitation through draining end portions of the cross-beams.

In EP 2 578 767 A2 an upwardly protruding band is arranged over the whole lateral side of the screen, preventing precipitation from draining along this lateral side and guiding precipitation towards the front for draining into a front gutter. Draining at the front however requires a steeper inclination of the screen, which is often undesired.

In WO 2013/169217 precipitation is prevented from dripping along the lateral sides of the screen, by means of a seal which is arranged above the screen.

SUMMARY

An object of embodiments of this invention is to provide a simple solution for the problem of dripping of precipitation along the lateral sides of the screen.

This object may be achieved by providing a screen covering comprising:

several cross-beams arranged so as to be slidable away from each other and towards each other;

a screen supported by the cross-beams and foldable between the cross-beams at sliding of the cross-beams;

and a lateral gutter, which extends essentially perpendicular to the cross-beams and is arranged below a lateral side of the screen;

wherein said lateral side of the screen is provided with a downwardly extending drip guard, which is foldable at sliding of the cross-beams.

It is possible that precipitation which falls onto the screen in its extended position is drained off into the mentioned lateral gutter, positioned at one lateral side of the screen. It is also possible to provide a lateral gutter on each lateral side of the screen. In the remainder of this patent application, only one lateral gutter and corresponding lateral side of the screen are referred to. It is however possible to have a further lateral gutter and corresponding drip guard at the other lateral side of the screen.

As the mentioned drip guard of a screen covering according to an embodiment of this invention is downwardly extending, it comprises an edge, which, in the extended position of the screen, is situated below the level of the screen extending between the cross-beams. Such edge assures that precipitation does not remain stuck onto the bottom of the screen due to adhesive force for too long a period. It guides the precipitation away from the bottom of the screen towards the lateral gutter.

In a preferred embodiment of a screen covering according to this invention, the screen extends beyond the cross-beams at said lateral side, seen in longitudinal direction of the cross-beams. Extending the screen beyond the cross-beams, brings the edge where precipitation falls off the screen closer to the outer side wall of the lateral gutter. It also eases folding of the screen and the drip guard, without wrinkling of the screen or twisting of the drip guard.

The drip guard of a screen covering according to an embodiment of the invention is preferably arranged beside the cross-beams. Arranging the drip guard beside the cross-beams also brings the edge where precipitation falls off the screen closer to the outer side wall of the lateral gutter. It also makes it easier to arrange the drip guard in an easily foldable way without wrinkling of the screen or twisting of the drip guard.

The drip guard is furthermore preferably provided over essentially the full length of said lateral side, such that an uninterrupted obstacle for the precipitation is provided.

In a simple embodiment of the invention, which is most preferred, the drip guard is arranged beside the cross-beams and extends over the full length of the lateral side.

This drip guard may, for example, be an external part, fixed to the screen, which is for example made from plastic or rubber, etc. or may for example be a brush. Such a drip guard can e.g. be fixed to the screen by sewing, heat sealing and/or adhesive bonding.

Alternatively, this drip guard can be provided as a part of the screen. The drip guard can then e.g. be provided by an extension of the screen beyond the cross-beams, which hangs down under the influence of the force of gravity. This extension of the screen can further more specifically be provided with a thickening to increase this influence.

A drip guard of a screen covering according to an embodiment of the invention is preferably made of a material which has a satisfactory resistance to UV and other weather conditions, such as e.g. PVC.

In a preferred embodiment, the drip guard is a flexible profile, fixed to the screen. Even more preferably, the drip guard is then a profile with a T-shaped cross section, which is fixed below said lateral side of the screen.

In a specific embodiment of a screen covering according to the invention, the lateral gutter comprises an outer side wall at its side away from the cross-beams and the drip guard extends up to the outer side wall of the lateral gutter. By draining off the water by means of a drip guard to the outer side wall of the lateral gutter, precipitation will stick to this outer side wall due to the adhesive force thereof and trickle downwards along this outer side wall into the lateral gutter. The risk of precipitation splashing up in the lateral gutter is consequently greatly reduced.

BRIEF DESCRIPTION OF THE DRAWINGS

This invention is now explained in greater detail on the basis of the hereinafter following detailed description of some preferred embodiments of a screen covering according to this invention. The aim of this description is solely to provide illustrative examples and to indicate further advantages and particularities of this invention, and thus cannot be interpreted as a limitation of the field of application of the invention or of the patent rights claimed in the claims.

In this detailed description, reference is made by means of reference numerals to the accompanying drawings, wherein in FIG. 1 a part of a screen covering according to the state of the art is represented in cross section at the height of a lateral side of the screen, with precipitation which is laterally drained off the screen.

DETAILED DESCRIPTION OF EMBODIMENTS

Figure 1:
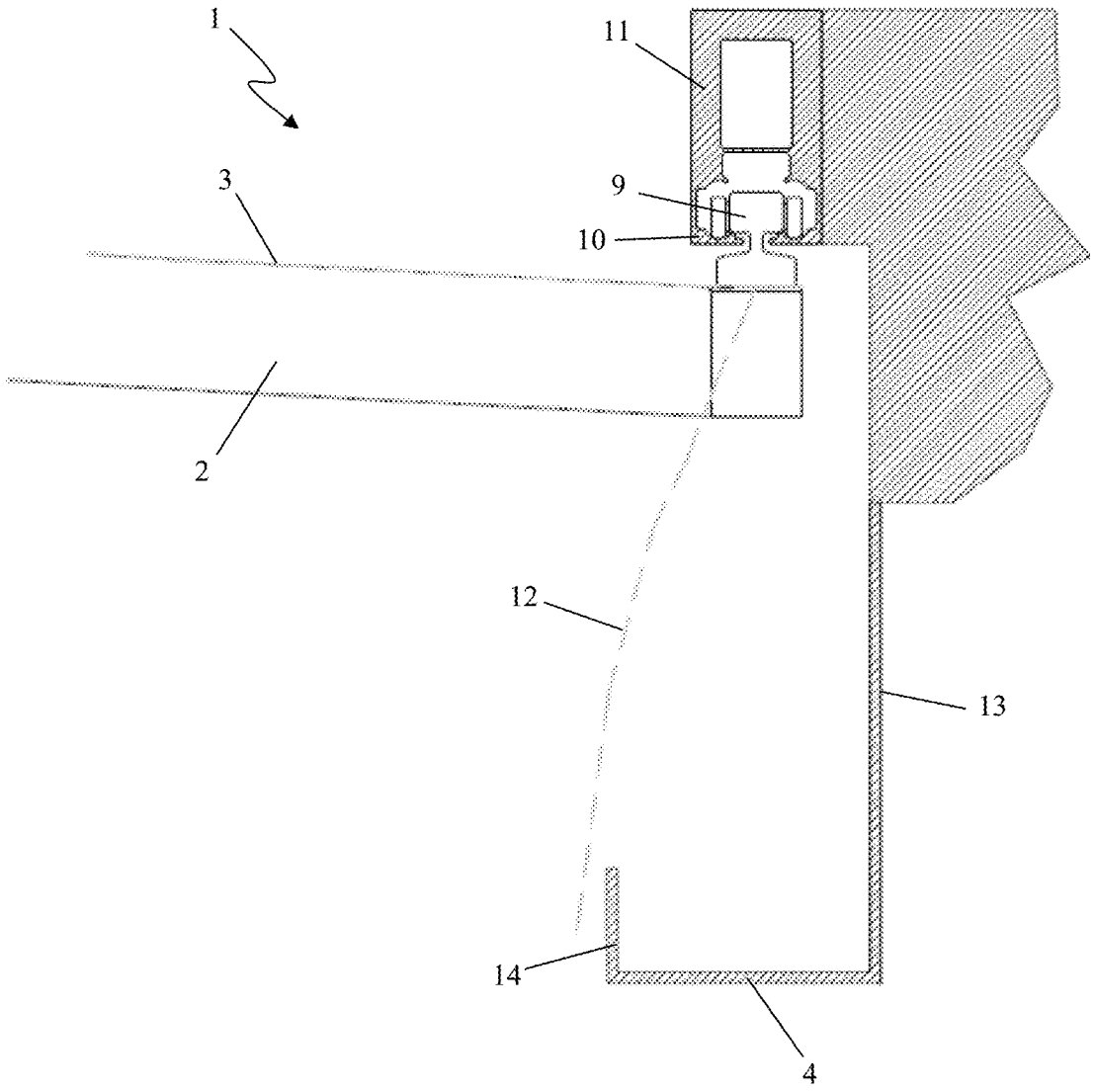

The illustrated screen coverings (1) comprise two lateral beams (11) which are arranged parallel to each other at a certain distance from each other. These beams (11) are provided at their bottom with a running rail (10).

The screen coverings (1) further comprise several cross-beams (2) extending essentially perpendicularly between the lateral beams (11). The cross-beams (2) are provided at their top with typical trolleys (9) which are rollably arranged in the running rails (10) of the lateral beams (11), such that the cross-beams (2) are hung from the lateral beams (11), slidable towards each other and away from each other by rolling the trolleys (9) in the running rails (10). In the figures, only one lateral beam (11) is illustrated. At the other side of the cross-beams (2)—which is not illustrated—a similar lateral beam (11) is arranged.

The cross-beams (2) are further supporting a screen (3), which is foldable between the cross-beams (2) at sliding of the cross-beams (2).

A lateral gutter (4) extends essentially perpendicular to the cross-beams (2) and is arranged below the illustrated lateral side of the screen (3). The inner side wall (14) of the lateral gutter (4) is arranged at a certain distance underneath the screen (3) such that the screen (3) is foldable above the lateral gutter (4). The outer side wall (13) of the lateral gutter (4) extends beside the screen (3).

In FIG. 1 it is illustrated with a screen covering (1) according to the state of the art, how precipitation which is laterally drained off the screen (3), can remain stuck to the bottom side of the screen (3) over a certain distance and then falls off the screen (3) besides the lateral gutter (4), into the area below the screen (3).

Figure 2:
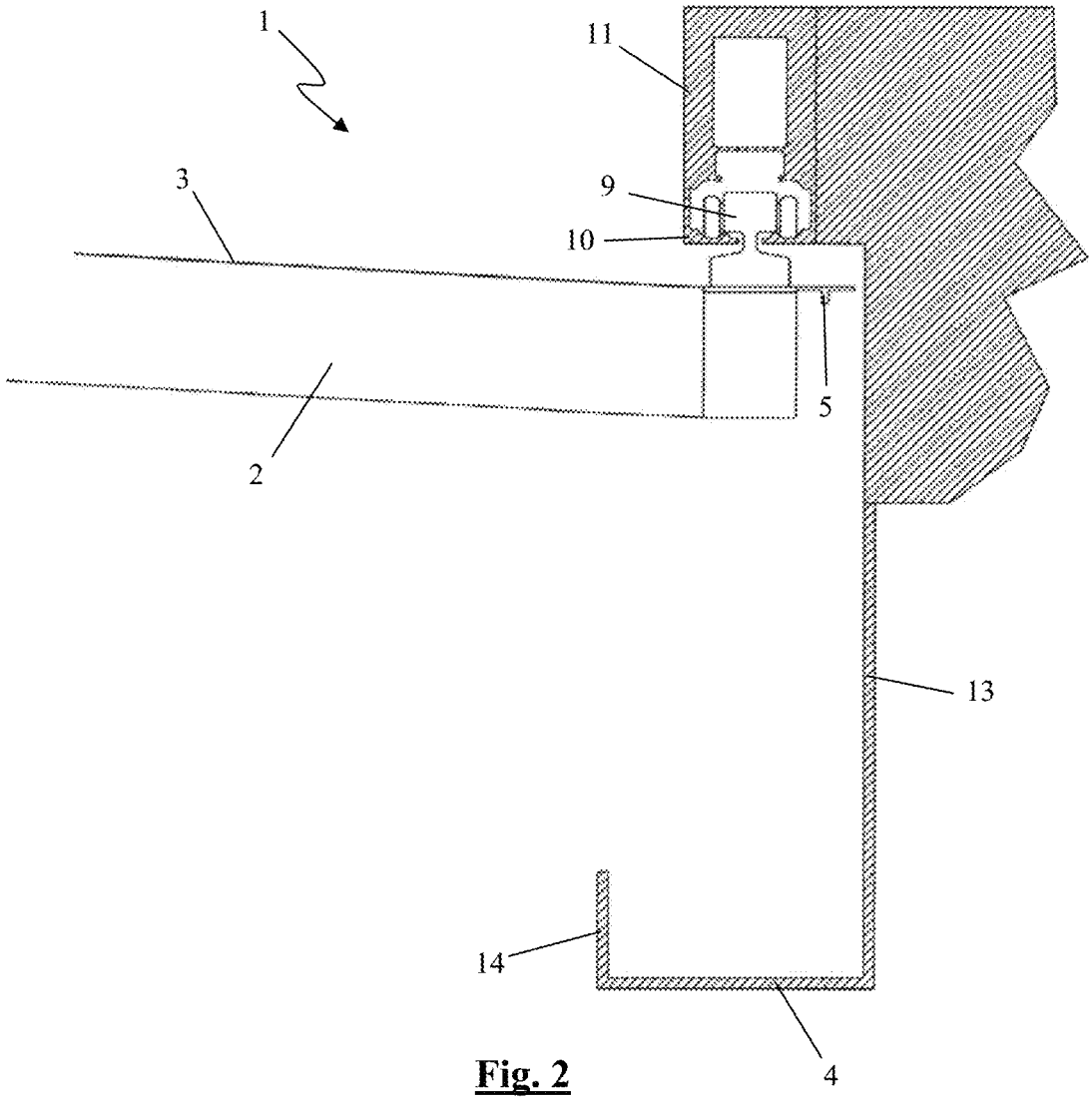
FIG. 2 a part of a screen covering according to an embodiment of the invention is represented in cross section at the height of a lateral side of the screen.
Figure 3:
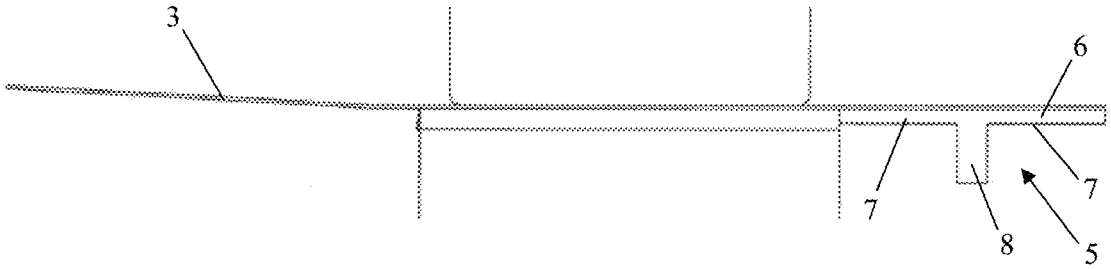
FIG. 3 a part of the screen covering of FIG. 2 is represented in more detail at the height of the drip guard.
Figure 4:
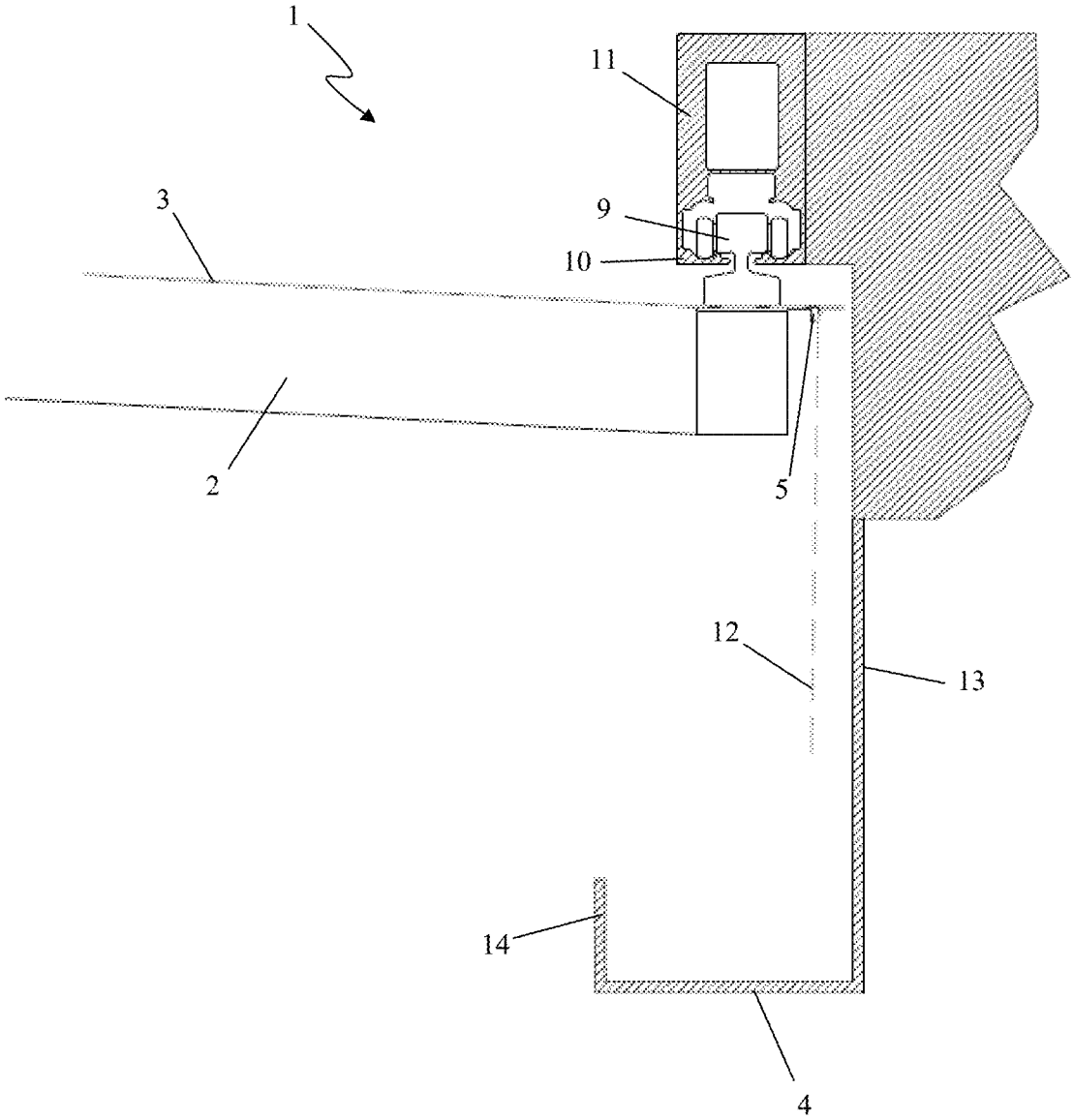
FIG. 4 the part of the screen covering of FIG. 2 is represented with precipitation which is laterally drained off the screen.

In FIGS. 2-3, seen in longitudinal direction of the cross-beams (2), the screen (3) of the screen covering (1) is therefore extended beyond the cross-beams (2) at this lateral side. Below the screen (3) a drip guard (5) is fixed to the lateral side of the screen (3). This drip guard (5) extends over the full length of the lateral side of the screen (3) beside the cross-beams (2), forming a continuous border for precipitation (12) sticking on the bottom of the lateral side of the screen (3). This drip guard (5) is a flexible profile such that it can be folded together with the screen (3). The profile of the drip-guard (5) has a T-shaped cross section. The flexible band (6) thereof can be fixed to the screen (3) by sewing or heat sealing or adhesive bonding, etc. The tongue (8) thereof extends downwards, dividing the flexible band (6) in two flanges (7) at both sides of the tongue (8). Thanks to this T-shape, the drip-guard (5) is foldable with reduced risk of twisting thereof. As can be seen in FIG. 4, the tongue (8) guides precipitation (12) towards the lateral gutter (4), such that precipitation (12) is drained at the lateral side of the screen (3) into this lateral gutter (4).

Figure 5:
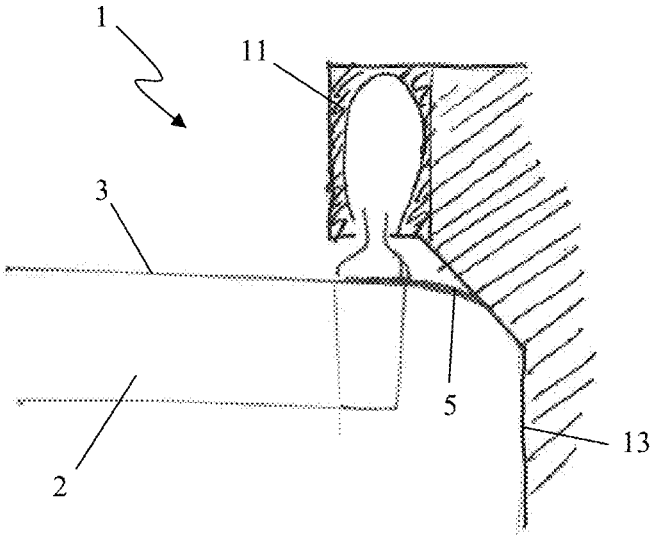
FIG. 5 a part of a second embodiment of a screen covering according to the invention is sketched in cross section at the height of a lateral side of the screen.

In FIG. 5, an alternative embodiment of a screen covering (1) according to the invention is sketched. Seen in longitudinal direction of the cross-beams (2), the screen (3) of the screen covering (1) is extended beyond the cross-beams (2) at the illustrated lateral side and extends up to the outer side wall (13) of the lateral gutter (14), which is not further illustrated. This outer side wall (13) forces the extension (5) of the screen (3) to extend downwards such that a drip guard (5) is formed as an integral part of the screen (3). As this drip guard (5) extends up to the outer side wall (13) of the lateral gutter (14), precipitation (12) which is drained off at this lateral side, will stick to this outer side wall (13) due to the adhesive force thereof and trickle downwards along this outer side wall (13) into the lateral gutter (14).

The invention claimed is:

1. A screen covering comprising:

several cross-beams arranged so as to be slidable away from each other and towards each other;

a screen supported by the cross-beams and foldable between the cross-beams at sliding of the cross-beams; and a lateral gutter, which extends essentially perpendicular to the cross-beams and is arranged below a lateral side of the screen;

wherein said lateral side of the screen is provided with a downwardly extending drip guard, which is foldable at sliding of the cross-beams, wherein the drip guard is provided essentially over the full length of said lateral side, and wherein the drip guard is a flexible profile, fixed to the screen.

2. The screen covering according to claim 1, characterised in that, seen in longitudinal direction of the cross-beams, the screen extends beyond the cross-beams at said lateral side.

3. The screen covering according to claim 2, characterised in that the drip guard is arranged beside the cross-beams.

4. The screen covering according to claim 1, characterised in that the drip guard is a profile with a T-shaped cross section, which is fixed below said lateral side of the screen.

5. The screen covering according to claim 1, characterised in that the drip guard is provided as a part of the screen.

6. The screen covering according to claim 1, wherein the lateral gutter comprises an outer side wall at its side away from the cross-beams and wherein the drip guard does not make contact with the outer side wall of the lateral gutter.

* * * * *